US011007402B2

(12) United States Patent
Armitage

(10) Patent No.: US 11,007,402 B2
(45) Date of Patent: May 18, 2021

(54) EXERCISE MAT

(71) Applicant: Liforme Limited, London (GB)

(72) Inventor: James Armitage, London (GB)

(73) Assignee: LIFORME LIMITED, London (GB)

( * ) Notice: Subject to any disclaimer, the term of this patent is extended or adjusted under 35 U.S.C. 154(b) by 252 days.

(21) Appl. No.: 15/339,095

(22) Filed: Oct. 31, 2016

(65) Prior Publication Data

US 2018/0117391 A1 May 3, 2018

(51) Int. Cl.
*A63B 21/00* (2006.01)

(52) U.S. Cl.
CPC ..... *A63B 21/4037* (2015.10); *A63B 2209/00* (2013.01)

(58) Field of Classification Search
CPC .. A63B 21/4037; A63B 2209/00; A63B 21/00
USPC ..... 5/417–420
See application file for complete search history.

(56) References Cited

U.S. PATENT DOCUMENTS 3,099,021 A * 7/1963 Wetzler ..... A47C 27/064 264/46.2
6,920,655 B2 * 7/2005 Mitchell ..... A47G 9/062 5/417
2012/0124740 A1 * 5/2012 Castle ..... A47D 15/003 5/420
2012/0240336 A1 * 9/2012 Dandapure ..... A63B 6/00 5/417

FOREIGN PATENT DOCUMENTS

CN 204932706 U 10/2016

* cited by examiner

*Primary Examiner* — Fredrick C Conley
(74) *Attorney, Agent, or Firm* — Hahn Loeser & Parks LLP

(57) ABSTRACT

An exercise mat comprising a base layer, a top layer formed of an absorbent material for absorbing sweat, and a barrier layer bonded between the top and base layers for preventing sweat from seeping from the top layer into the base layer in use. Preferably, the barrier layer is formed of a breathable material.

13 Claims, 1 Drawing Sheet

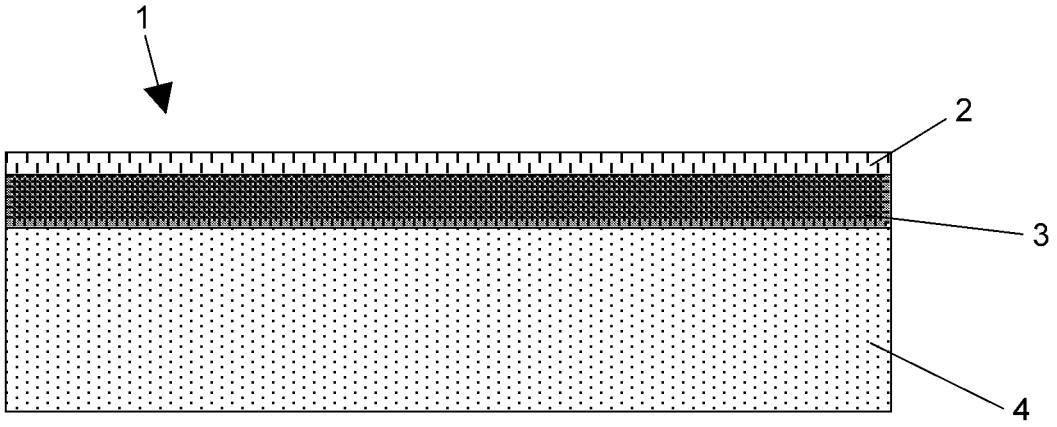
1
2
3
4

EXERCISE MAT

The present invention concerns an exercise mat for use in mat based exercises, such as yoga or stretching.

In this connection, exercise mats are commonly used by users to perform a wide variety of gym exercises as they provide a softer and cleaner surface upon which to work out. A wide variety of exercises can be conducted on such mats, from press-ups and sit-ups, to stretches and yoga postures.

One of the issues with exercise mat design is to achieve an appropriate balance between cushioning and stability. Typically, polymer foams are used in exercise mat constructions, with thicker or more cushioned foams providing greater cushioning, but at the expense of some user stability. However, one of the issues with foam materials is that they can absorb a user's sweat over time, which can be unhygienic and risks prematurely degrading the foam material. To address this, exercise mats are often formed with a waterproof outer surface to prevent sweat seeping into the foam interior. Unfortunately, an issue with such exercise mat constructions is that the waterproof outer results in sweat pooling on the mat's surface, which may reduce a user's grip on contact. This is particularly problematic for yoga, where a user may be relying on the grip of their contact with the mat surface to maintain a yoga posture.

The present invention therefore seeks to address the above issues with conventional exercise mats.

According to a first aspect of the present invention there is provided an exercise mat comprising a base layer; a top layer formed of an absorbent material for absorbing sweat; and a barrier layer bonded between the top and base layers for preventing sweat from seeping from the top layer into the base layer in use.

Preferably, the base layer is formed of natural rubber. Alternatively, the base layer is formed of other open cell foam materials.

Preferably, the top layer is formed of polyurethane.

Preferably, the barrier layer is formed of a waterproof material.

Preferably, the barrier layer is formed of a breathable material.

Preferably, the barrier layer is a middle layer having a first surface bonded to the top layer and a second surface bonded to the base layer.

Preferably, the barrier layer is formed as a fabric layer.

Preferably, the barrier layer is formed of polyester or nylon.

Preferably, the barrier layer is heat bonded to the base layer and/or the top layer.

Preferably, the base layer is formed of silicone.

Preferably, the top layer is formed of silicone.

According to a second aspect of the present invention there is provided a method of making an exercise mat comprising: providing a barrier layer having first and second surfaces and being for preventing sweat from seeping from the first surface to the second surface; depositing a top layer onto the first surface of the barrier layer, said top layer being an absorbent material for absorbing sweat; depositing a base layer onto the second surface of the barrier layer.

Preferably, the steps of depositing the top layer and the base layer comprise bonding to the barrier layer.

Preferably, the steps of depositing the top layer and the base layer comprise the barrier layer being heat bonded to the base layer and/or the top layer.

Preferably, the base layer is formed of silicone.

Preferably, the top layer is formed of silicone.

Illustrative embodiments of the present invention will now be described with reference to the accompanying drawings in which:

FIG. 1 shows a schematic cross sectional view through an exercise mat of an embodiment of the invention.

FIG. 1 shows an exercise mat 1 according to an embodiment of the present invention. In this embodiment, the exercise mat 1 is intended for use in yoga. The exercise mat 1 is formed of 3 layers: a thin absorbent top surface layer 2; waterproof middle layer 3; and a sturdy base layer 4 at bottom of mat.

The top surface layer 2 provides the upper surface upon which the user practices, for instance, yoga exercises. The top surface layer 2 is formed from a thin absorbent material and is capable of absorbing sweat deposited on the mat's surface, thus allowing the surface to remain grippy for the user. In this embodiment, the absorbent top surface layer 2 is formed of polyurethane foam. Alternative materials are also envisaged, such as rubber or synthetic rubber, or other foam materials (e.g. PVC, TPE, or silicone).

As the absorbency of the top surface layer 2 would potentially allow sweat to seep down through the mat, a thin waterproof middle layer 3 is provided between the surface layer and the base layer 4. The waterproofing prevents sweat from the top surface reaching the base layer 4 below.

The waterproof middle layer 3 is formed as a fabric layer and is preferably made of polyester or nylon. In use, this layer functions as a barrier layer to prevent sweat reaching the base layer 4, which might otherwise lead to degradation of the base layer material and microbe or bacteria growth within it.

In this embodiment, the base layer 4 is made of natural rubber. Natural rubber is preferred because it is non-toxic and eco-friendly as a result of its biodegradability. Furthermore, natural rubber allows the density of the base layer to be controlled during manufacture. This is advantageous because it allows the balance between soft cushioning and firm stability to be adjusted for optimising the exercise mat for specific activities and exercises, such as yoga.

With the above arrangement, the waterproof middle layer 3 therefore provides a hygienic barrier to sweat for the otherwise susceptible base layer 4. At the same time, the absorbent top surface absorbs and wicks away sweat to provide the user with enhanced grip during exercises, even if the mat is wet.

The exercise mat 1 according to an embodiment of the invention may be constructed as follows. The waterproof middle layer 3 is provided as a fabric backer onto which the polyurethane material forming the top surface layer 2 is deposited. The top surface layer material may be melted onto the waterproof middle layer 3 to provide secure integrated bonding between the layers in a heat joining effect.

The bonded waterproof middle layer 3 and top surface layer 2, formed of the polyurethane and waterproof fabric backer, is then used as a substrate onto which the natural rubber forming the base layer 4 is deposited. The base layer 4 material is melted as it is foamed onto the waterproof fabric backer, resulting again in a heat joining effect between the middle layer 3 and the base layer 4. This heat induced bonding between the layers helps to prevent de-lamination during use of the mat.

To further aid manufacture, the waterproof middle layer 3 is preferably formed of a fabric backer material that is at least partially breathable. The breathable quality of the fabric allows the rubber which forms the base layer 4 to be more effectively foamed during the manufacturing process.

It will be understood that the embodiment illustrated above shows applications of the invention only for the purposes of illustration. In practice the invention may be applied to many different configurations, the detailed embodiments being straightforward for those skilled in the art to implement.

The invention claimed is:

1. An exercise mat comprising:

a foamed base layer;

a top layer formed of an absorbent material; and a waterproof and breathable barrier layer heat bonded between the top and base layers, said base layer being foamed and melted onto said barrier layer during manufacture of the exercise mat, the breathability of said barrier layer improving the effectiveness of said base layer, whereby said top layer absorbs sweat and said barrier layer prevents sweat from seeping from said top layer into said base layer when the exercise mat is in use.

2. An exercise mat according to claim 1 wherein the base layer is formed of natural rubber.

3. An exercise mat according to claim 1 wherein the top layer is formed of polyurethane.

4. An exercise mat according to claim 1, wherein the base layer is formed of silicone.

5. An exercise mat according to claim 1, wherein the top layer is formed of silicone.

6. An exercise mat according to claim 1 wherein the barrier layer is a middle layer having a first surface bonded to the top layer and a second surface bonded to the base layer.

7. An exercise mat according to claim 1 wherein the barrier layer is formed as a fabric layer.

8. An exercise mat according to claim 1 wherein the barrier layer is formed of polyester or nylon.

9. A method of making an exercise mat comprising:

providing a waterproof and breathable barrier layer having first and second surfaces;

heat bonding a top layer onto the first surface of the barrier layer, said top layer being an absorbent material;

foaming and melting a base layer onto the second surface of the barrier layer, the breathability of the barrier layer improving the effectiveness of the base layer, whereby said top layer absorbs sweat and said barrier layer prevents sweat from seeping from said top layer into said base layer when the exercise mat is in use.

10. A method according to claim 9 wherein the barrier layer is provided as a fabric layer.

11. A method according to claim 9 wherein the barrier layer is formed of polyester or nylon.

12. A method according to claim 9 wherein the top layer is formed of polyurethane.

13. A method according to claim 9 wherein the base layer is formed of natural rubber.

* * * * *